US007182074B1

(12) United States Patent
Redon et al.

(10) Patent No.: US 7,182,074 B1
(45) Date of Patent: Feb. 27, 2007

(54) MANIFOLD ASSEMBLY FOR AN INTERNAL COMBUSTION ENGINE

(75) Inventors: Fabien Georges Redon, Farmington Hills, MI (US); Jared Jobey Keyes, Madison Heights, MI (US); Michael A. Balnaves, Canton, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 11/209,071

(22) Filed: Aug. 22, 2005
(Under 37 CFR 1.47)

(51) Int. Cl.
*F02M 25/07* (2006.01)
*F02B 47/08* (2006.01)
*F01M 5/00* (2006.01)
*F01P 1/06* (2006.01)

(52) U.S. Cl. ..... 123/568.12; 123/196 AB; 123/184.21; 123/41.31

(58) Field of Classification Search ..... 123/41.33, 123/568.11, 568.12, 196 AB, 184.21, 184.61, 123/41.01, 41.31, 195 C
See application file for complete search history.

(56) References Cited

U.S. PATENT DOCUMENTS 3,937,196 A * 2/1976 Cook et al. ..... 123/568.12
4,134,377 A * 1/1979 Bamsey et al. ..... 123/568.12
4,267,812 A * 5/1981 Aula et al. ..... 123/568.12
4,273,082 A 6/1981 Tholen
5,732,688 A 3/1998 Charlton et al.
6,272,851 B1 8/2001 Mori et al.
6,340,011 B1 1/2002 Jainek
6,360,702 B1 3/2002 Osada
6,502,397 B1 1/2003 Lundqvist
6,513,507 B2 2/2003 Balekai et al.
6,748,906 B1 * 6/2004 White et al. ..... 123/41.01
6,752,133 B2 * 6/2004 Arnell ..... 123/568.12
2002/0129783 A1 * 9/2002 Lawrence ..... 123/195 C
2006/0000430 A1 * 1/2006 Takahashi ..... 123/41.31

FOREIGN PATENT DOCUMENTS

JP 3-114563 11/1991
JP 3-114564 11/1991
JP 5106519 4/1993

* cited by examiner

*Primary Examiner*—Willis R. Wolfe, Jr.
(74) *Attorney, Agent, or Firm*—Brooks Kushman P.C.

(57) ABSTRACT

A manifold assembly for an internal combustion engine. The manifold assembly includes a manifold body and first and second housings. The manifold body includes an EGR cooler cavity, an oil cooler cavity, and an air intake manifold. The first housing is adapted to provide a fluid to the EGR and oil cooler cavities. The second housings is adapted to receive the fluid from the EGR and the oil cooler cavities.

20 Claims, 4 Drawing Sheets

MANIFOLD ASSEMBLY FOR AN INTERNAL COMBUSTION ENGINE

STATEMENT REGARDING FEDERALLY SPONSORED RESEARCH OR DEVELOPMENT

The invention was made with Government support under Contract Nos. DE-FC05-970R22909 and DE-FC05-020R22909. The Government has certain rights to the invention.

BACKGROUND OF THE INVENTION

1. Field of the Invention

The present invention relates to a manifold assembly for use with an internal combustion engine, such as a diesel engine.

2. Background Art

Various manifold assemblies have been utilized with internal combustion engines, such as that described in U.S. Pat. No. 6,513,507.

SUMMARY OF THE INVENTION

According to one aspect of the present invention, a manifold assembly for an internal combustion engine is provided. The manifold assembly includes a manifold body, a first housing, and a second housing. The manifold body includes an EGR cooler cavity for receiving an EGR cooler, an oil cooler cavity for receiving an oil cooler, and an air intake manifold configured to provide a gas mixture to the internal combustion engine. The first housing is adapted to provide a fluid to the EGR and oil cooler cavities. The second housing is adapted to receive the fluid from the EGR and oil cooler cavities.

The EGR cooler may include an exhaust gas inlet. The air intake manifold may include an air inlet. The exhaust gas inlet and the air inlet may be disposed proximate opposite ends of the manifold body.

The gas mixture in the air intake manifold and exhaust gas in the EGR cooler may flow in opposite directions. Exhaust gas in the EGR cooler and oil in the oil cooler cavity may flow in a first direction. The fluid, which may be a coolant, may flow through the EGR cooler cavity and the oil cooler in a second direction.

The manifold body may include an integrally formed exhaust gas passage connecting the air intake manifold to a chamber of the first housing that receives exhaust gas from the EGR cooler.

According to another aspect of the present invention, a manifold assembly for an internal combustion engine is provided. The manifold assembly includes a manifold body, an EGR cooler, an oil cooler, a first housing, and a second housing. The manifold body includes an EGR cooler cavity, an oil cooler cavity, and an air intake manifold. The EGR and oil cooler cavities extend between first and second surfaces of the manifold body. The air intake manifold is configured to provide a gas mixture to the internal combustion engine. The EGR cooler is disposed in the EGR cooler cavity. The oil cooler is disposed in the oil cooler cavity. The first housing is disposed proximate the first surface and is adapted to provide coolant to the EGR cooler cavity and the oil cooler. The second housing is disposed proximate the second surface and is adapted to receive coolant from the EGR cooler cavity and the oil cooler.

The manifold body may include first and second coolant passages. The first coolant passage may extend between the first surface and the EGR cooler cavity. The second coolant passage may extend between the EGR cooler cavity and the second surface. The first and second coolant passages may be coaxially disposed and may be separated by a partition.

The oil cooler cavity may include an oil transport groove disposed adjacent to the oil cooler. The oil transport groove may extend along at least a portion of the oil cooler cavity in a direction extending between the first and second surfaces. An oil outlet passage may be provided that extends between the oil cooler cavity and the second surface.

According to another aspect of the present invention, an manifold assembly for an internal combustion engine for a vehicle is provided. The manifold assembly includes an integrally formed manifold body having a first surface and a second surface disposed opposite the first surface, an EGR cooler, an oil cooler, a first housing, and a second housing. The integrally formed body includes an EGR and oil cooler cavities extending between the first and second surfaces and an air intake manifold. The air intake manifold has an air inlet, an exhaust gas inlet, and an outlet configured to provide a gas mixture to the internal combustion engine. The EGR cooler is disposed in the EGR cooler cavity. The oil cooler is disposed in the oil cooler cavity. The first housing is disposed proximate the first surface and includes a coolant inlet and a first chamber for providing coolant to the EGR and oil cooler cavities. The second housing is disposed proximate the second surface and includes a coolant outlet and a second chamber for receiving coolant from the EGR and oil cooler cavities.

The integrally formed manifold body may include an upper surface disposed near the EGR cooler cavity, a mounting boss for mounting a fuel rail assembly. and/or a vent opening disposed proximate the upper surface. A pressure sensor may be disposed at an end of the air intake manifold opposite the air inlet.

The EGR cooler cavity may be disposed above the oil cooler cavity and below the air intake manifold. The EGR cooler cavity, the oil cooler cavity, and air intake manifold may be disposed generally parallel to each other.

DETAILED DESCRIPTION OF THE EMBODIMENT(S)

Detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
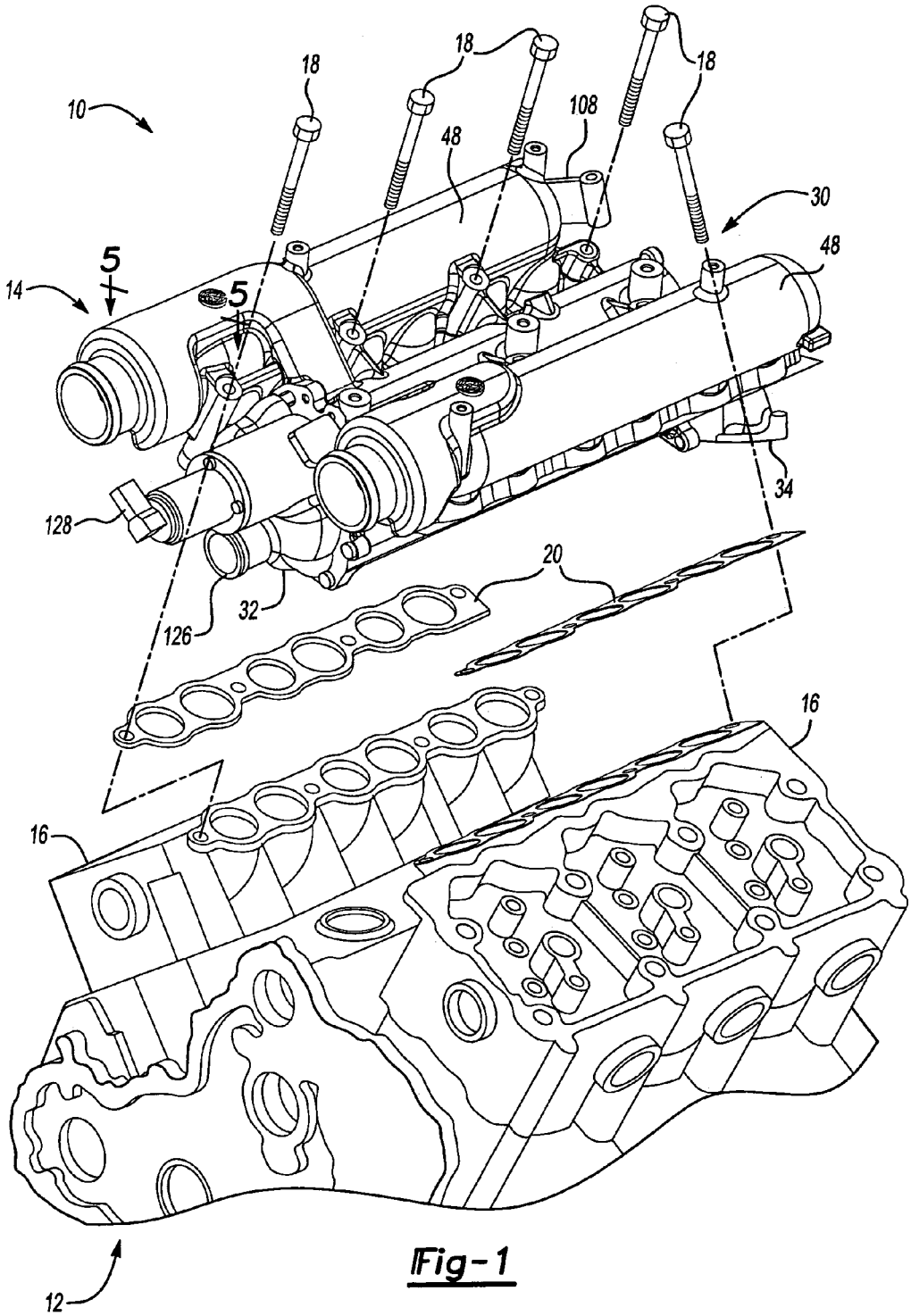
FIG. 1 is an exploded perspective view showing an engine and a manifold assembly.

Referring to FIG. 1, a schematic of an engine system 10 is shown. As will be appreciated by those of ordinary skill in the art, the engine system 10 may be used in a wide variety of equipment, such as trucks, construction equipment, marine vessels, and stationary generators. Moreover, it should be noted that the present invention is not limited to a particular type of engine or fuel.

The engine system 10 may include an engine 12 and a manifold assembly 14. The engine 12 may be an internal combustion engine and may have any suitable configuration. In at least one embodiment, the engine 12 may include one or more cylinder heads 16.

The manifold assembly 14 may be mounted on the engine 12 in any suitable manner, such as with one or more fasteners 18. The manifold assembly 14 may be configured to provide a gas mixture to the cylinder heads 16 as is described in more detail below. A gasket 20 may be disposed between the manifold assembly 14 and cylinder head 16 to promote sealing.

In a vehicular application, the engine 12 may be adapted to drive vehicle traction wheels. For example, the engine 12 may be connected to a transmission that includes a plurality of gear ratios. The transmission may be connected to a driveshaft, which is in turn connected to a differential. The differential may be connected to one or more axles, each axle being adapted to turn to a vehicle traction wheel. Thus, engine torque may be transmitted through the transmission, differential, and axles to turn the vehicle traction wheels.

Figure 2:
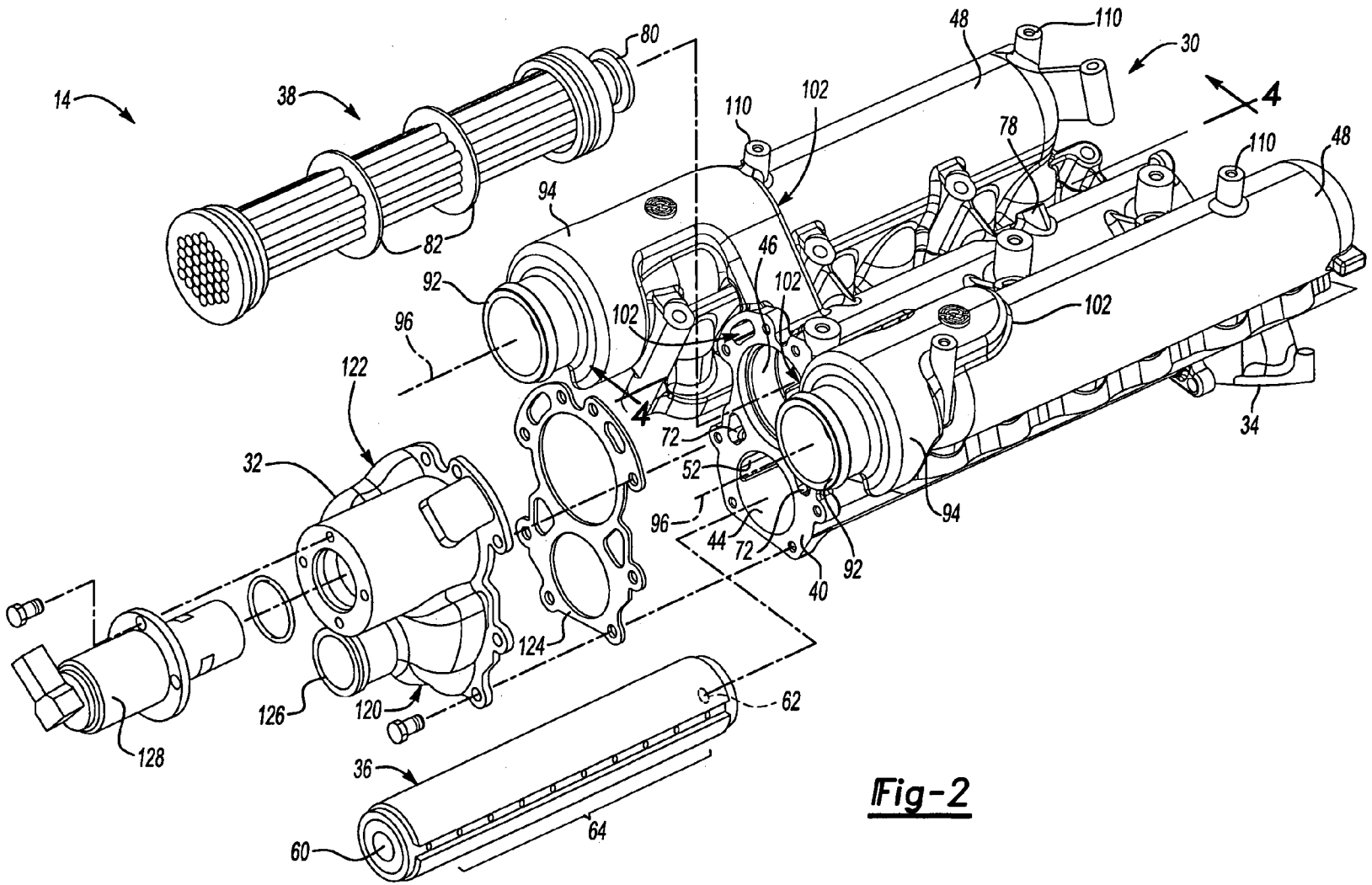
FIG. 2 is an exploded perspective view of the manifold assembly shown in FIG. 1.
Figure 3:
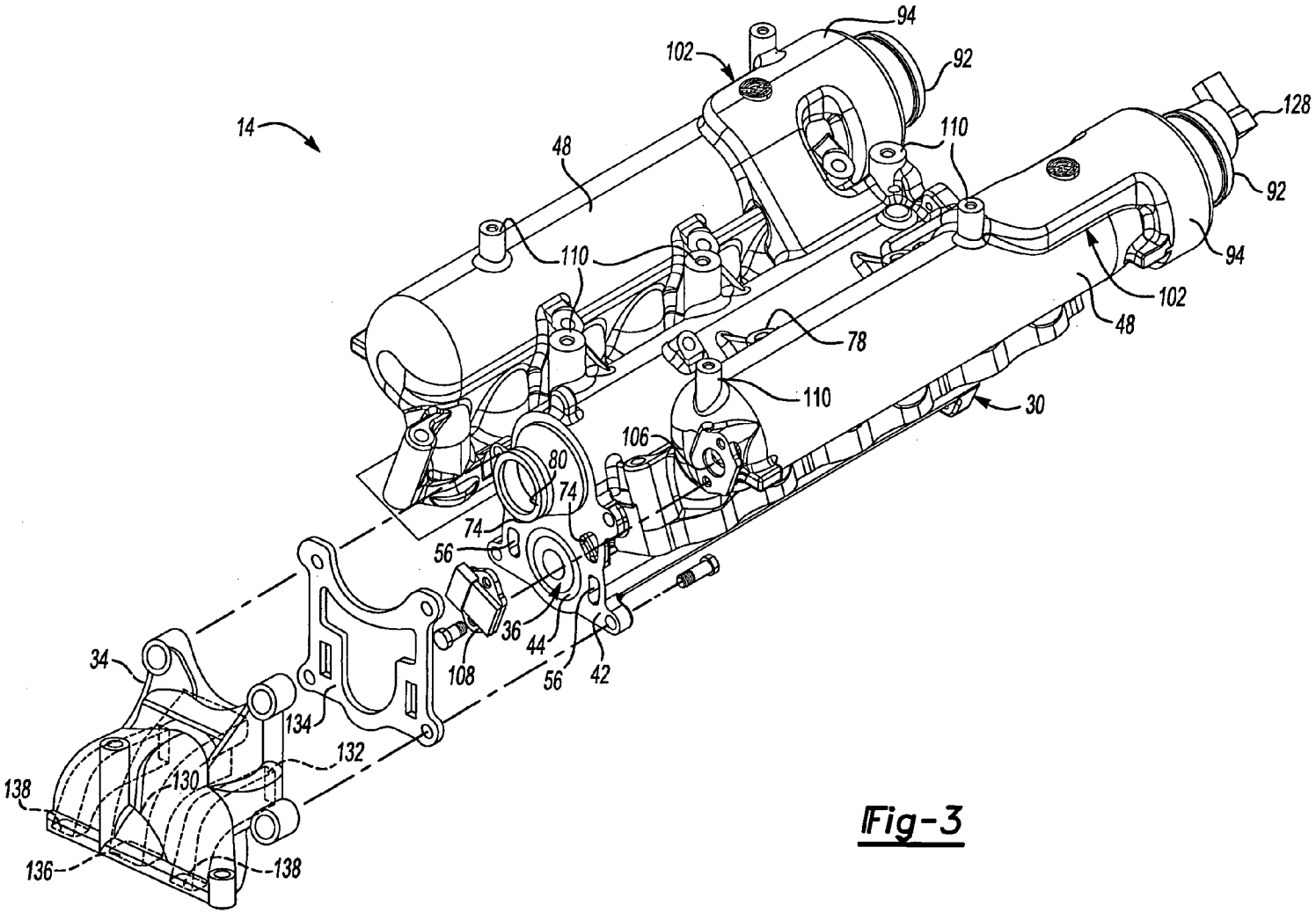
FIG. 3 is an exploded perspective view of the opposite side of the manifold assembly shown in FIG. 2.

Referring to FIGS. 2 and 3, an exemplary manifold assembly 14 is shown in more detail. In the embodiment shown, the manifold assembly 14 includes a manifold body 30, a first housing 32, a second housing 34, an oil cooler 36, and an EGR cooler 38.

The manifold body 30 may be integrally formed and may be made of any suitable material, such as a metal like iron, aluminum, or alloys thereof. In addition, the manifold body 30 may be made in any suitable manner. For example, a casting technique, such as a lost foam casting process, may be employed.

The manifold body 30 may have any suitable configuration. In at least one embodiment, the manifold body includes a first surface 40, a second surface 42, an oil cooler cavity 44, an EGR cooler cavity 46, and one or more air intake manifolds 48. In addition, the manifold body 30 may include a plurality of passages for transporting fluids, examples of which will be described below in greater detail.

The first and second surfaces 40,42 may be disposed on opposite sides of the manifold body 30. In addition, the first and second surfaces 40,42 may be configured to facilitate mounting of the first and second housings 32,34, respectively.

The oil cooler cavity 44 is adapted to receive the oil cooler 36 and may have any suitable configuration. In the embodiment shown, the oil cooler cavity 44 has a generally cylindrical configuration and extends between the first and second surfaces 40,42 along an axis 50.

The oil cooler cavity 44 may include one or more oil transport grooves 52 that facilitate fluid transport. The oil transport grooves 52 may extend along at least a portion of the oil cooler cavity 44 in any suitable direction. In the embodiment shown, two oil transport grooves 52 are provided on opposite sides of the oil cooler cavity 44 and generally extend between the first and second surfaces 40,42.

One or more oil passages may be associated with the oil cooler cavity 44. In the embodiment shown, one oil inlet passage 54 and two oil outlet passages 56 are provided in the manifold body 30.

The oil inlet passage 54 may be configured to receive oil from another component, such as the engine 12, and permit oil to flow to oil cooler cavity 44 and/or oil transport grooves 52. The oil inlet passage 54 may have any suitable configuration. For example, the oil inlet passage 54 may extend from a surface of the manifold body 30, such as the first surface 40 or a lower surface of the manifold body 30 disposed proximate the engine 12 to the oil cooler cavity 44.

The oil outlet passages 56 are configured to direct oil from the oil cooler cavity 44 and/or oil transport grooves 52 to another component, such as the engine 12. The oil outlet passages 56 may have any suitable configuration. For example, one or more oil outlet passages 56 may extend from the oil cooler cavity 44 to any surface of the manifold body 30, such as the second surface 42 as is shown in FIG. 3.

Referring to FIG. 2, an exemplary oil cooler 36 is shown in more detail. The oil cooler 36 may have any suitable configuration. For instance, the oil cooler 36 may include at least one inlet 60 and at least one outlet 62 that permit any suitable fluid that facilitates heat transfer, designated coolant herein, to flow through the oil cooler 36. In addition, the oil cooler 36 may include one or more oil passages 64 that permit oil to flow through at least a portion of the oil cooler 36 without mixing with the cooling fluid. The oil passages 64 may have any suitable configuration and may be provided in any suitable quantity. In the embodiment shown, the oil passages 64 are oriented generally perpendicular to the axis 50 and extend between the oil transport grooves 52. The oil cooler 36 may also include one or more seals, such as O-rings, that help create a fluid-tight seal between the oil cooler 36 and the oil cooler cavity 44.

The EGR cooler cavity 46 is adapted to receive the EGR cooler 38 and may have any suitable configuration. In the embodiment shown, the EGR cooler cavity 46 has a generally cylindrical configuration and extends between the first and second surfaces 40,42 along an axis 70.

One or more coolant passages may be associated with the EGR cooler cavity 44. In the embodiment shown, two coolant inlet passages 72 and two coolant outlet passages 74 are provided.

The coolant inlet passages 72 are configured to receive coolant from another component, such as the first housing 32, and provide coolant to the EGR cooler cavity 46. The coolant inlet passages 72 may have any suitable configuration. In the embodiment shown, the coolant inlet passages 72 extend between the first surface 40 and the EGR cooler cavity 46.

The coolant outlet passages 74 are configured to direct coolant from the EGR cooler cavity 46 to another component, such as the second housing 34. The coolant outlet passages 74 may have any suitable configuration. In the embodiment shown, the coolant outlet passages 74 extend between the EGR cooler cavity 46 and the second surface 42.

The coolant inlet and outlet passages 72,74 may be separated by a wall or partition 76. As such, coolant is directed from the coolant inlet passage 72 into the EGR cooler cavity 46 and toward the EGR cooler 38 before being permitted to exit the EGR cooler cavity 46. Optionally, at least a portion of each coolant inlet passage 72 may be aligned with or coaxially disposed with a coolant outlet passage 74. In addition, the coolant inlet and outlet passages 72,74 may be provided such that coolant flows in any suitable direction, such as from the first surface 40 toward the second surface 42 or vice versa.

Figure 4:
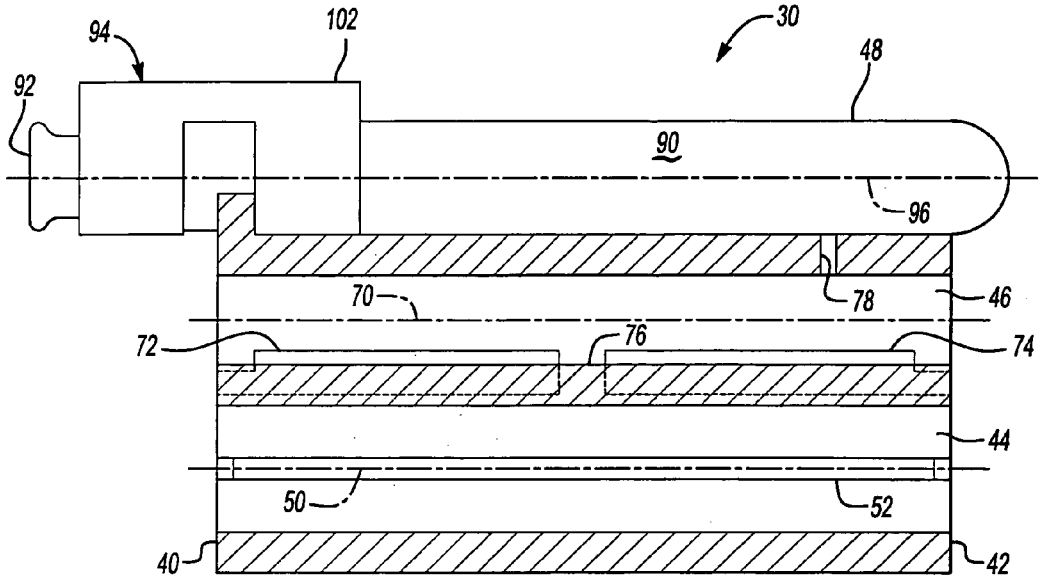
FIG. 4 is a section view of the manifold assembly along line 4—4.

The EGR cooler cavity 46 may also include a vent opening 78. The vent opening 78 may be provided in any suitable location. As shown in FIGS. 3 and 4, the vent opening 78 may disposed proximate an upper surface of the EGR cooler cavity 46. As such, the vent opening 78 may be disposed at the highest point of an engine cooling system. Optionally, a tube may be connected to the vent opening 78 and routed to the radiator, coolant reservoir, or the like to facilitate coolant expansion and/or the release of gases from the cooling system.

Referring to FIG. 2, an exemplary EGR cooler 38 is shown in more detail. The EGR cooler 38 is configured to cool exhaust gas to decrease its specific volume. The EGR cooler 38 may have any suitable configuration. In the embodiment shown, the EGR cooler 38 includes a plurality of tubes disposed in a generally parallel relationship through which exhaust gas flows. Exhaust gas may be provided to the plurality of tubes via an exhaust gas inlet 80. The EGR cooler 38 may also include one or more baffles 82 that help direct the flow of coolant around the tubes. As such, the EGR cooler 38 and EGR cooler cavity 46 cooperate to define a heat exchanger having a tube-and-shell configuration. The EGR cooler 38 may also include one or more seals, such as O-rings, that help create a fluid-tight seal between the EGR cooler 38 and the EGR cooler cavity 46.

The manifold body 30 may include one or more air intake manifolds 48. The air intake manifold 48 is adapted to provide a gas mixture, such as air and/or engine exhaust gas, to the engine 12 to facilitate combustion. Any suitable number of air intake manifolds may be provided that have the same or different configurations. In the embodiment shown, two air intake manifolds 48 are provided that are similarly configured. Each air intake manifold 48 may include a cavity 90, an air inlet 92, and an exhaust gas manifold 94. In addition, each air intake manifold 48 may be disposed along an axis 96. In embodiments having multiple air intake manifolds, air intake manifold axes may be disposed in the same or different directions. For instance, the axes 96 may be disposed generally parallel to each other and may be disposed in a plane as shown in FIG. 2.

The air inlet 92 is configured to receive intake air from any suitable source and direct the intake air into the cavity 90. For example, intake air may be ambient air or may be cooled with a heat exchanger, such as an intercooler (also known as a charge air cooler), to increase its density. In addition, the intake air may be pressurized by any suitable compression device, such as a supercharger or turbocharger. In the embodiment shown, the air inlet 92 is disposed at an end of the air intake manifold 48.

Figure 5:
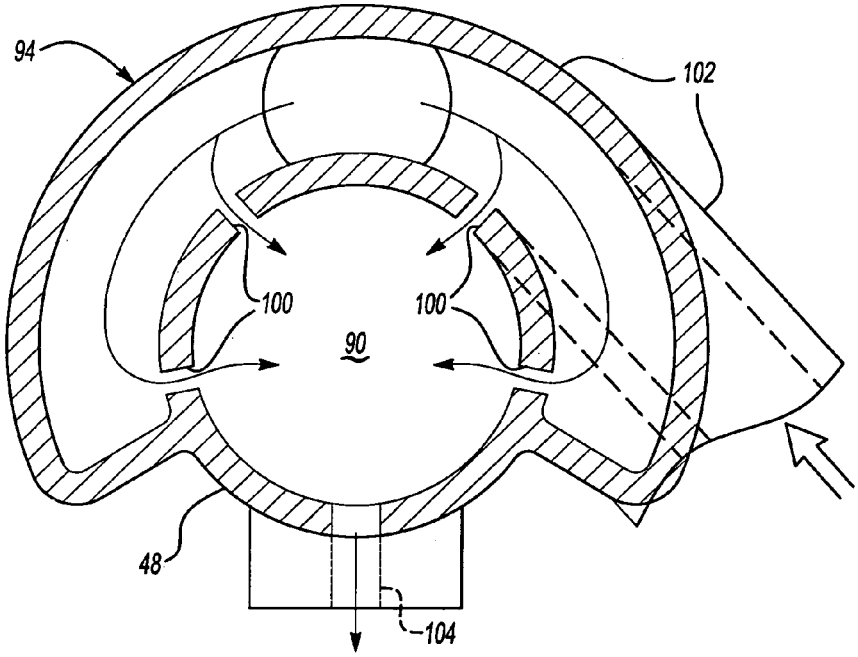
FIG. 5 is a section view of the manifold assembly along line 5—5.

The exhaust gas manifold 94 may be configured to provide exhaust gas that has been cooled by the EGR cooler 38 to the air intake manifold 48. The exhaust gas manifold 94 may have any suitable configuration. In the embodiment shown in FIG. 5, the exhaust gas manifold 94 extends along at least a portion of an exterior surface of the air intake manifold 48 and may be integrally formed with the manifold body 30.

The exhaust gas manifold 94 may also include one or more apertures 100 that permit exhaust gas to flow from the exhaust gas manifold 94 into the cavity 90. The apertures 100 may be configured and/or positioned to facilitate mixing of exhaust gas and intake air. In the embodiment shown, the apertures 100 are spaced apart around the exterior surface of the air intake manifold 48 and disposed generally perpendicular to the axis 96. In addition, the exhaust gas manifold 94 may be disposed in any suitable location. For instance, the exhaust gas manifold 94 may be provided near the air inlet 92 to promote mixing of intake air and exhaust gas.

One or more exhaust gas passages 102 may be configured to provide exhaust gas to the air intake manifold 48 and/or exhaust gas manifold 94. In the embodiment shown, an exhaust gas passage 102 is associated with each air intake manifold 48. The exhaust gas passages 102 may have any suitable configuration. In the embodiment shown, each exhaust gas passage 102 extends between the first surface 40 and the exhaust gas manifold 94. Each exhaust gas passage 102 may be integrally formed with the manifold body 30.

The gas mixture in the air intake manifold 48 may be provided to the engine 12 via one or more ports 104. The ports 104 may have any suitable configuration and may be provided in any suitable quantity. In the embodiment shown in FIG. 1, the ports 104 extend between the cavity 90 and an exterior surface of the air intake manifold 48 and are configured to provide the gas mixture to the cylinder head 16.

The air intake manifold 48 may include an aperture 106 for receiving a pressure sensor 108. The pressure sensor 108 may be of any suitable type and may be disposed in any suitable location, such as proximate an end of the air intake manifold 48 disposed opposite the air inlet 92. The pressure sensor 108 may be attached in any suitable manner, such as with one or more fasteners.

The manifold body 30 may also include one or more mounting bosses 110. The mounting bosses 110 may be configured to receive another component, such as fuel rail, fuel rail assembly, and/or a beauty cover that at least partially conceals the engine 12 to provide a more aesthetically pleasing appearance.

The oil cooler cavity 44, EGR cooler cavity 46, and/or air intake manifolds 48 may be disposed in any suitable relationship. For instance, the oil cooler cavity 44 may be disposed above or below the EGR cooler cavity 46 and/or the air intake manifold 48. Similarly, the EGR cooler cavity 46 may be disposed above or below the oil cooler cavity 44 and/or the air intake manifold 48. In the embodiment shown, the oil cooler cavity 44 and EGR cooler cavity 46 are disposed in a center area of the manifold body 30 and between the air intake manifolds 48. The oil cooler cavity 44, EGR cooler cavity 46, and/or air intake manifolds 48 may be disposed in a generally parallel relationship as is best shown in FIG. 4 or non-parallel relationships. For example, the oil cooler axis 50 and EGR cooler axis 70 may be generally parallel to each other and may be disposed in a first plane. Similarly, the air intake manifold axes 96 may be disposed generally parallel to each other and in a second plane. The first and second planes may be disposed in an orthogonal or non-orthogonal relationship.

Referring to FIG. 2, the first housing 32 is shown in more detail. The first housing 32 may have any suitable configuration. In the embodiment shown, the first housing 32 includes first and second chambers 120,122. The first housing 32 may be configured to mount to the first surface 40 in any suitable manner, such as with one or more fasteners. In addition, a gasket 124 may be disposed between the first surface 40 and the first housing 32 to facilitate sealing.

The first chamber 120 may be configured to provide coolant to the oil and EGR cooler cavities 44,46. More specifically, the first chamber 120 may receive coolant from another component, such as the engine 12, via an inlet 126 and direct coolant to the EGR cooler cavity 46 via the coolant inlet passages 72 and to the oil cooler inlet 60.

The second chamber 122 may direct exhaust gas from the EGR cooler 38 to exhaust gas passages 102. The second chamber 122 may also receive an EGR valve 128 for controlling the flow of exhaust gas from the EGR cooler 38 to one or more exhaust gas passages 102.

Referring to FIG. 3, the second housing 34 is shown in more detail. The second housing 34 may have any suitable configuration. In the embodiment shown, the second housing 34 includes a coolant chamber 130 and at least one oil chamber 132. The second housing 34 may be configured to mount to the second surface 42 in any suitable manner, such as with one or more fasteners. In addition, a gasket 134 may be disposed between the second surface 42 and the second housing 34 to facilitate sealing.

The coolant chamber 130 may be adapted to receive coolant from the oil and EGR cooler cavities 44,46 and directs coolant to another component, such as the engine 12, via an coolant outlet 136.

The oil chambers 132 may receive oil from the oil cooler cavity 44. More specifically, each oil chamber 132 may be associated with an oil outlet passage 56 and may direct oil to another component, such as the engine 12, via an oil outlet 138.

Fluids in the manifold assembly 14, such as coolant, exhaust gas, oil, intake air gas mixtures may flow in any suitable direction or directions. In the embodiment shown in the Figures, coolant, oil, and intake air gas mixures generally flow in a direction extending from the first surface 40 toward the second surface 42 while exhaust gas in the exhaust gas cooler 38 flows in the opposite direction. The present invention comtemplates that any fluid or combinations thereof may flow in the same or different direction as another fluid.

The present invention permits multiple components to be consolidated into a common assembly to help reduce weight and package space. For instance, EGR and oil coolers as well as the air intake manifold may be integrated in a single manifold body instead of being provided as separate components. This integration helps reduce components, such as mountings, tubing, and connectors, that were previously needed when these features were provided as separate components. In addition, integration also helps reduce costs and improve quality and manufacturing efficiency since fewer parts and manufacturing steps are required.

The present invention also facilitates improved engine system performance. The integrated, compact construction reduces flow distances for gases and fluids. As a result, there is less opportunity for heat pickup by fluids cooled by the heat exchangers and improved responsiveness to commands for increased torque or acceleration. In addition, the present invention helps improve mixing uniformity of exhaust gas and intake air mixing under all air flow conditions. Moreover, the present invention allows EGR volumes to be reduced, thereby improving balancing of exhaust gas and intake air. In addition, the present invention may be employed with a diesel engine to help improve fuel economy and reduce emissions. For instance, improved cooling and EGR mixing helps increase the amount of air provided to each cylinder and helps reduce emissions when combined with other combustion improvements.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A manifold assembly for an internal combustion engine, the manifold assembly comprising:

a manifold body including:

an EGR cooler cavity for receiving an EGR cooler, an oil cooler cavity spaced apart from the EGR cooler cavity for receiving an oil cooler, and an air intake manifold configured to provide a gas mixture to the internal combustion engine;

a first housing adapted to provide a fluid to the EGR and oil cooler cavities; and a second housing adapted to receive the fluid from the EGR and oil cooler cavities.

2. The manifold assembly of claim 1 wherein the EGR cooler cavity and the oil cooler cavity are disposed generally parallel to each other.

3. The manifold assembly of claim 1 wherein the fluid is a coolant and exhaust gas in the EGR cooler and oil in the oil cooler cavity flow in a first direction and the coolant in the EGR cooler cavity and the oil cooler flow in a second direction.

4. The manifold assembly of claim 1 wherein the EGR cooler further comprises an exhaust gas inlet and the air intake manifold includes an air inlet, wherein the exhaust gas inlet and air inlet are disposed proximate opposite ends of the manifold body.

5. The manifold assembly of claim 1 wherein the gas mixture in the air intake manifold and exhaust gas in the EGR cooler flow in opposite directions.

6. The manifold assembly of claim 1 wherein the manifold body further comprises an integrally formed exhaust gas passage connecting a chamber of the first housing that receives exhaust gas from the EGR cooler to the air intake manifold.

7. A manifold assembly for an internal combustion engine, the manifold assembly comprising:

a manifold body including:

an EGR cooler cavity and an oil cooler cavity, the EGR and oil cooler cavities extending between first and second surfaces, and an air intake manifold configured to provide a gas mixture to the internal combustion engine;

an EGR cooler disposed in the EGR cooler cavity;

an oil cooler disposed in the oil cooler cavity;

a first housing disposed proximate the first surface and adapted to provide a coolant to the EGR cooler cavity and the oil cooler; and a second housing disposed proximate the second surface and adapted to receive coolant from the EGR cooler cavity and the oil cooler.

8. The manifold assembly of claim 7 further comprising an oil outlet passage extending between the oil cooler cavity and the second surface.

9. The manifold assembly of claim 7 wherein the manifold body further comprises a first coolant passage extending between the first surface and the EGR cooler cavity and a second coolant passage extending between the EGR cooler cavity and the second surface.

10. The manifold assembly of claim 9 wherein the first and second coolant passages are coaxially disposed and separated by a partition.

11. The manifold assembly of claim 7 wherein the oil cooler cavity further comprises an oil transport groove disposed adjacent to the oil cooler.

12. The manifold assembly of claim 11 wherein the oil transport groove extends along at least a portion of the oil cooler cavity in a direction extending between the first and second surfaces.

13. A manifold assembly for an internal combustion engine for a vehicle, the manifold assembly comprising:

an integrally formed manifold body having a first surface and a second surface disposed opposite the first surface, the integrally formed body including:

an EGR cooler cavity extending between the first and second surfaces, an oil cooler cavity extending between the first and second surfaces, and an air intake manifold having an air inlet, an exhaust gas inlet, and an outlet configured to provide a gas mixture to the internal combustion engine;

an EGR cooler disposed in the EGR cooler cavity;

an oil cooler disposed in the oil cooler cavity;

a first housing disposed proximate the first surface, the first housing having a coolant inlet and a first chamber for providing coolant to the EGR and oil cooler cavities; and a second housing disposed proximate the second surface, the second housing having a second chamber for receiving coolant from the EGR and oil cooler cavities and a coolant outlet.

14. The manifold assembly of claim 13 wherein the first housing further comprises an EGR valve.

15. The manifold assembly of claim 13 wherein the integrally formed manifold body further comprises an upper surface and a vent opening extending between the EGR cooler cavity and the upper surface.

16. The manifold assembly of claim 13 further comprising a pressure sensor disposed at an end of the air intake manifold opposite the air inlet.

17. The manifold assembly of claim 13 wherein the integrally formed manifold body further comprises an upper surface disposed near the EGR cooler cavity and a mounting boss for mounting a fuel rail assembly disposed proximate the upper surface.

18. The manifold assembly of claim 13 wherein the EGR cooler cavity is disposed above the oil cooler cavity.

19. The manifold assembly of claim 13 wherein the air intake manifold is disposed above the EGR cooler cavity.

20. The manifold assembly of claim 13 wherein the EGR cooler cavity, oil cooler cavity, and air intake manifold are disposed generally parallel to each other.

* * * * *